US012723787B2

(12) United States Patent
Chikami

(10) Patent No.: US 12,723,787 B2
(45) Date of Patent: Sep. 1, 2026

(54) REFRIGERATION DEVICE

(71) Applicant: Daikin Europe N.V., Ostend (BE)

(72) Inventor: Hideo Chikami, Osaka (JP)

(73) Assignee: DAIKIN EUROPE N.V., Ostend (BE)

( * ) Notice: Subject to any disclaimer, the term of this patent is extended or adjusted under 35 U.S.C. 154(b) by 120 days.

(21) Appl. No.: 18/837,349

(22) PCT Filed: Feb. 7, 2023

(86) PCT No.: PCT/EP2023/052939
§ 371 (c)(1),
(2) Date: Aug. 9, 2024

(87) PCT Pub. No.: WO2023/152110
PCT Pub. Date: Aug. 17, 2023

(65) Prior Publication Data

US 2025/0155169 A1 May 15, 2025

(30) Foreign Application Priority Data

Feb. 11, 2022 (EP) ..... 22156381

(51) Int. Cl.
*F25B 41/24* (2021.01)

(52) U.S. Cl.
CPC ..... *F25B 41/24* (2021.01)

(58) Field of Classification Search
CPC ..... F25B 41/24; F25B 2313/003; F25B 2313/006; F25B 2313/0233;
(Continued)

(56) References Cited

U.S. PATENT DOCUMENTS

2011/0302949 A1* 12/2011 Honda ..... F24D 3/18 62/324.6
2019/0257531 A1* 8/2019 Chikami ..... F24D 17/02
(Continued)

FOREIGN PATENT DOCUMENTS

CN 214536910 U 10/2021
EP 2363667 A2 9/2011
(Continued)

OTHER PUBLICATIONS

Japanese Office Action for Japanese Application No. 2024-547444, dated Oct. 7, 2025, with English translation.
(Continued)

*Primary Examiner* — Nelson J Nieves
(74) *Attorney, Agent, or Firm* — Birch, Stewart, Kolasch & Birch, LLP

(57) ABSTRACT

A refrigeration device configured to be used in a heating mode and a cooling mode, comprising a compressor (1), a plurality of utilization side heat exchangers, an expansion mechanism (4) and a heat source side heat exchanger (5) fluidly connected in series to constitute a refrigeration circuit. The refrigeration device also comprises a first refrigerant pipe (6), which extends from the compressor (1) to a first utilization side heat exchanger (2) of the plurality of utilization side heat exchangers and comprises a first valve (7) configured to at least fully open and fully close the first refrigerant pipe (6), as well as a second refrigerant pipe (8), which extends from the compressor (1) to a second utilization side heat exchanger (3.1, 3.2, 3.3) of the plurality of utilization side heat exchangers and comprises a second valve (9) configured to at least fully open and fully close the second refrigerant pipe (8). The refrigeration device further comprises a controller, which is configured to control the operation of the first valve (7) and the second valve (9). When the first utilization side heat exchanger (2) and the
(Continued)

second utilization side heat exchanger (3.1, 3.2, 3.3) are both operated, when the refrigeration device is used in the heating mode, the controller is configured to compare a predetermined capacity of the heat source side heat exchanger (5) and/or the compressor (1) with a required capacity of the first utilization side heat exchanger (2) and the second utilization side heat exchanger (3.1, 3.2, 3.3). When the required capacity exceeds the predetermined capacity, the controller is configured to close the first valve (7) or the second valve (9).

18 Claims, 2 Drawing Sheets

(58) Field of Classification Search
CPC .... F25B 2313/02334; F25B 2600/2515; F25B 2600/2519
See application file for complete search history.

(56) References Cited

U.S. PATENT DOCUMENTS

2020/0378642 A1* 12/2020 Shimizu ..... F24F 11/64
2021/0018236 A1* 1/2021 Sanada ..... F25B 41/24
2021/0041128 A1* 2/2021 Kato ..... F24F 11/83
2021/0164711 A1* 6/2021 Ryu ..... F25B 47/022
2021/0215406 A1* 7/2021 Tanaka ..... F25B 49/02
2022/0364776 A1* 11/2022 Kopko ..... F24F 5/001
2022/0404061 A1* 12/2022 Honda ..... F24F 1/16
2023/0049970 A1* 2/2023 Jung ..... F24D 3/18
2023/0145285 A1* 5/2023 Takahashi ..... F25B 41/00 62/291
2025/0102171 A1* 3/2025 Iuchi ..... F25B 49/02

FOREIGN PATENT DOCUMENTS

EP 2503266 A1 9/2012
EP 2653805 A1 10/2013
JP 61-107066 A 5/1986
JP 62-252855 A 11/1987
JP 1-256762 A 10/1989
JP 8-261599 A 10/1996
JP 2001-280723 A 10/2001
JP 2006-125722 A 5/2006
JP 2010-196955 A 9/2010
JP 2018-185082 A 11/2018
WO WO 2013/136368 A1 9/2013
WO WO 2017/183308 A1 10/2017

OTHER PUBLICATIONS

International Search Report, issued in PCT/EP2023/052939, PCT/ISA/210, dated May 4, 2023.
Written Opinion of the International Searching Authority, issued in PCT/EP2023/052939, PCT/ISA/237, dated May 4, 2023.

* cited by examiner

REFRIGERATION DEVICE

BACKGROUND OF THE INVENTION

Technical Field

The present invention relates to a refrigeration device, preferably a heat pump type air conditioning and hot water supply device, that is configured to be used in a heating mode and a cooling mode, and is capable of simultaneously providing an air conditioning load and a hot water load.

Background of the Present Invention

In general, refrigeration devices that comprise a compressor, a plurality of utilization side heat exchangers, an expansion mechanism and a heat source side heat exchanger, which are fluidly connected in series to constitute a refrigerant circuit, are known in the prior art. Such refrigerant circuits enable to provide cooling or heating depending on the direction in which a refrigerant is flown through such a refrigerant circuit.

Nowadays, refrigeration devices have been developed that are configured to provide air conditioning and hot water supply at the same time. That is, such refrigeration devices comprise a plurality of utilization side heat exchangers, wherein at least one of said utilization side heat exchangers is configured to generate, for example, hot water when said refrigerant circuit is used in a heating mode. In addition, at least one further utilization side heat exchanger of the plurality of utilization side heat exchangers is configured to provide air conditioning.

Such refrigeration devices that are capable of providing domestic hot water and/or domestic heating, when the refrigerant circuit is used in a heating mode, are also known as heat pump type air conditioning and hot water supply devices and are oftentimes abbreviated as "DHW-DX combined systems".

In other words, such combined systems can be understood as combined air conditioning and hot water supply systems that are capable of simultaneously providing an air conditioning load and a hot water load.

An example for such a previously known refrigeration device is derivable from EP 2 653 805 A1. Therein, a known DHW-DX combined system is described, which is capable of providing domestic hot water and air conditioning with warm air at the same time, but also enables to use the refrigerant in the refrigerant circuit, for example, only for air conditioning or for producing hot water, when said refrigeration device is used in a heating mode.

Nonetheless, in such DHW-DX combined systems also a plurality of utilization side heat exchangers, for example, in the form of a plurality of air conditioning indoor units in several rooms, can be provided.

However, in such known DHW-DX combined systems, which operate a plurality of utilization side heat exchangers at the same time in a heating mode, situations may occur, which result in a compromised performance of either the hot water supply, the air conditioning of an indoor space, or even both.

This is mainly caused by the systems urge to maintain the capacity limit of the whole system. In such a situation, the required capacity of the utilization side heat exchangers exceeds the available, deployable capacity of the compressor and the heat source side heat exchanger. Put differently, the required capacity of the utilization side heat exchangers exceeds an available capacity of the compressor and/or the heat source side heat exchanger.

That is, when a plurality of utilization side heat exchangers are operated in a heating mode and the combined system is not able to supply all of them with sufficient heating capacity, the existing combined systems result in a cold draft, an undesired cooling of the hot water tank, and/or an insufficient heating of an indoor space.

This is particularly disadvantageous, because the performance of the DHW-DX combined system gives the user the feeling of a malfunction of the system.

SUMMARY OF THE INVENTION

In view of the above, it is an object of the present invention to prevent such undesired situations for the user. It is also an object of the present invention to provide a refrigeration device that can provide a desired performance, even when the available capacity limit is reached or exceeded.

This object is solved by means of an apparatus according to claim 1. Distinct embodiments are derivable from the dependent claims.

According to a first aspect, a refrigeration device comprises a compressor, a plurality of utilization side heat exchangers, an expansion mechanism and a heat source side heat exchanger fluidly connected in series to constitute a refrigeration circuit.

Further, the refrigeration device comprises a first refrigerant pipe, which extends from the compressor to a first utilization side heat exchanger of the plurality of utilization side heat exchangers, and which comprises a first valve configured to at least fully open and fully close the first refrigerant pipe.

The refrigeration device further comprises a second refrigerant pipe, which extends from the compressor to a second utilization side heat exchanger of the plurality of utilization side heat exchangers, and which comprises a second valve configured to at least fully open and fully close the second refrigeration pipe.

A high-pressure refrigerant in a at least partially gaseous state, preferably a fully gaseous state, may flow through the first and second refrigerant pipe, when the refrigeration device is used in a heating mode.

In this context, the first refrigerant pipe and the second refrigerant pipe are also to be understood as pipings that form part of the refrigeration circuit.

Additionally, the "first valve" and the "second valve" are to be understood as valves that are able to block and open the first refrigerant pipe and the second refrigerant pipe.

That is, when the first valve and/or the second valve are/is closed, the first refrigerant pipe and/or the second refrigerant pipe are blocked, such that no refrigerant can flow through said pipes.

The refrigeration device also comprises a controller, which is configured to control the operation of the first valve and the second valve.

Said controller is configured to compare a predetermined capacity of the heat source side heat exchanger and/or the compressor with a required capacity of the first utilization side heat exchanger and the second utilization side heat exchanger. The controller is s configured to perform said comparison when the first utilization side heat exchanger and the second utilization side heat exchanger are both operated when the refrigeration device is used in the heating mode.

In this case, the controller is configured to close the first valve or the second valve, when said required capacity exceeds the predetermined capacity.

In other words, the present invention introduces a software logic in a DHW-DX combined system, which is configured to be used in a heating mode and a cooling mode, that addresses the issue of a compromised performance of both the DX and DHW part when capacity limits are met.

That is, a compromised performance can be omitted and a satisfying performance of the refrigeration device can be ensured, even when the first utilization side heat exchanger and the second utilization side heat exchanger are both operated, when the refrigeration device is used in the heating mode and a required capacity exceeds a predetermined capacity.

It becomes clear that it is a key idea of the present invention to introduce an automatic prioritization that ensures that the desired part of the DHW-DX combined system is operated with sufficient capacity, and the less relevant part of the combined system is on hold. It is thereby possible to achieve a monitoring of operation conditions of the system during a hot water production/supply and room heating operation. The claimed refrigeration device enables to judge whether the simultaneous operation of hot water supply (DHW) and room heating operation (DX) is feasible or not.

If a parallel operation can be maintained, no software control and the corresponding closing of the first valve or the second valve is required.

However, when the claimed controller determines that a limitation to perform the dual operation (DHW and DX operation) is present due to extreme operational conditions, the controller enables an additional prioritization, such that one of the domestic heating or domestic hot water production is continued or enhanced. Accordingly, the limitation issue in terms of performance due to a parallel operation can be omitted and one of the hot water supply or heating operation can be given a bigger focus.

Consequently, the claimed configuration allows the user to enjoy an improved performance of a single operation (space heating or hot water production/supply).

Put differently, such extreme operational conditions are to be understood as situations, in which a "production side" of the refrigeration circuit (i.e. the compressor and/or the heat source side heat exchanger) are not capable of satisfying the capacity needs of a "utilization side" of the refrigeration circuit (i.e. the first and second utilization side heat exchangers).

Here, the "predetermined capacity" is relevant in a control mode when the first and second utilization side heat exchangers are operated.

Preferably, the predetermined capacity is a maximum capacity of the heat source side heat exchanger and/or the compressor.

This enables to use the maximum capacity available at any time—irrespective of the amount of available or operated utilization side heat exchangers.

Preferably, the controller is configured to close the first valve or the second valve based on a predetermined user priority.

This allows to adjudge what operation (space heating or domestic hot water production) shall be prioritized and is more important for the user. Hence, the system can be adapted to the user's needs in situations, in which the required capacity exceeds the available capacity of the refrigeration device.

Such situations may, for example, occur when a large amount of utilization side heat exchangers is operated and a large temperature difference between the desired temperature and the current temperature in a hot water tank or in a space to be heated is apparent.

Preferably, the controller is configured to change the predetermined user priority based on the time of day.

Accordingly, the system can be adapted according to various daily activities of the user. Hence, it is, for example, possible to have sufficient hot water for taking a shower in the morning and a hot living room, i.e. a heated space, in the afternoon to enjoy a relaxed evening.

Preferably, the first and second refrigerant pipes extend in parallel from the compressor. More preferably, the first and second refrigerant pipes extend in parallel via a branching pipe arranged on a downstream side of the compressor.

Accordingly, one pipe that leaves the compressor can be provided, and the first and second refrigerant pipes can be connected thereto.

The first utilization side heat exchanger is a hot water supply unit, preferably a coil in a tank, for producing domestic hot water, when the refrigeration device is used in a heating mode.

Preferably, a second utilization side heat exchanger is an air conditioning indoor unit or a radiator for heating a space, in which the second utilization side heat exchanger is positioned, when the refrigeration device is used in a heating mode and/or for cooling the space, in which the second utilization side heat exchanger is positioned, when the refrigeration device is used in a cooling mode.

Accordingly, a combined domestic hot water and domestic heating (and cooling) system, also known as a combined DHW-DX system can be provided.

Preferably, a plurality of second utilization side heat exchangers are arranged in parallel on a downstream side of the second valve in the second refrigerant pipe. Accordingly, a refrigeration device may be provided that can have several indoor units to heat, for example, different rooms in one refrigeration device.

Preferably, the refrigeration device further comprises a switching device. The switching device may be configured to switch the refrigerant circuit from the heating mode to the cooling mode. More preferably, the switching device may be a four-way switching valve.

Accordingly, the DHW-DX system may be switched from a cooling mode to a heating mode in which, for example, the hot water supply unit and the air conditioning indoor unit may both be able to heat an indoor space and water in a water tank for producing domestic hot water.

Preferably, the controller is configured to determine the predetermined capacity based on an amount of provided second utilization side heat exchangers.

Such a configuration enables to adjudge whether the capacity of the compressor and/or the heat source side heat exchanger may suffice to sufficiently provide all of the provided second utilization side heat exchangers—even under extreme operational conditions. Hence, a deteriorated performance of the refrigeration device, when the first and second utilization side heat exchanger are operated can be omitted, and the prioritized heating operation (heating a space or producing hot water) can be performed.

That is, when, for example, the system detects that the capacity of the compressor, is sufficient to supply compressed refrigerant to the detected amount of provided second utilization side heat exchangers, no prioritization has to be performed and none of the first valve and second valve has to be closed. Yet, when the controller determines that the predetermined capacity resulting from the detected amount of provided second utilization side heat exchangers exceeds the maximum capacity, a prioritization is performed.

More preferably, the controller is configured to determine and/or adjust the predetermined capacity based on an amount of operated second utilization side heat exchangers.

Accordingly, a more agile and flexible control of the refrigeration devices can be achieved. Furthermore, it is possible to continuously evaluate whether the prioritization of the first utilization side heat exchanger or the second utilization side heat exchanger must still be performed or not. That is, as soon as an amount of operated second utilization side heat exchangers changes, for example, because the air conditioning indoor unit in an indoor space is turned off, the system can react accordingly.

Preferably, the controller is configured to determine the predetermined capacity based on a volume of the first utilization side heat exchanger, such as the hot water supply unit, more preferably, based on the volume of the tank, and/or based on a volume of the compressor.

Hence, the controller enables to adjudge the available performance of the system based on the elements that form the refrigerant circuit.

In addition, the claimed refrigeration device including the controller can flexibly react on a rearrangement or adaption of the refrigeration device in different installation situations and/or a change of parts of the refrigerant circuit.

Preferably, the controller is configured to determine the required capacity based on a threshold between a refrigerant temperature at the heat source side heat exchanger and the refrigerant temperature at the second utilization side heat exchanger.

Hence, it can be easily determined whether a capacity of the combined DHW-DX system is enough to allow a simultaneous performance of both, heating a space and producing hot water at the same time.

Alternatively, the controller may be configured to determine the required capacity based on a threshold between an actual temperature in the space in which the second utilization side heat exchanger is positioned, when the refrigeration device is used in a heating mode, and a desired temperature in the space.

Accordingly, a temperature delta may be acquired to judge whether the provided capacity of the DHW-DX combined system is sufficient to remedy the temperature difference between the desired temperature and the actual temperature in the space to be heated, while hot water is simultaneously produced.

As a further alternative configuration, the controller may be configured to determine the required capacity based on a threshold between an actual in temperature the first utilization side heat exchanger, such as the hot water supply unit, and a desired temperature in the first utilization side heat exchanger.

Similar to the aforesaid, a temperature delta in the hot water tank of the hot water supply unit may be crucial to determine whether a simultaneous heating of a space and a production of hot water can be performed with the available capacity of the refrigeration device or not.

Preferably, the second utilization side heat exchanger is the air conditioning indoor unit and the controller is configured to determine the required capacity based on a threshold between the actual discharge air temperature leaving the air conditioning indoor unit and a desired discharge air temperature.

Also in such a configuration, a delta in the temperature between the desired discharge temperature and the actual discharge temperature may be determined. This is crucial to determine whether a simultaneous operation can be sufficiently performed in the combined DHW-DX system or whether a prioritization of heating a space, in which the second utilization side heat exchanger is provided, and a production of hot water (by the first utilization side heat exchanger) has to be performed by closing the second valve or the first valve.

Preferably, the second utilization side heat exchanger comprises a fan. The controller may be configured to determine the required capacity based on a threshold between an actual fan speed and a maximum fan speed.

In this light, it may be determined whether a capacity of a second utilization side heat exchanger comprising a fan may suffice to achieve the desired air temperature while a parallel hot water production is performed.

Preferably, the controller is configured to close the second valve and open the first valve, when the actual temperature in the space, in which the second utilization side heat exchanger is positioned, reaches or exceeds a desired temperature in the space.

Such a configuration enables a controlled switch between a situation, in which the operation of the first utilization side heat exchanger or the second utilization side heat exchanger is prioritized, and the desired temperature goal is met.

In other words, the claimed controller can reactivate both, an operation of a hot water production and a heating of a space, in which the second utilization side heat exchanger may be provided.

In addition to the above-described controller behavior when the actual temperature in the space reaches or exceeds a desired temperature, the controller may also be configured to close the first valve and open the second valve, when the actual temperature in the first utilization side heat exchanger, such as the hot water supply unit, reaches or exceeds a desired temperature.

Similar to the aforesaid, the claimed controller is thereby able to reactivate the simultaneous operation of the hot water production and heating of the space, as soon as a desired temperature in the hot water supply unit is met or even exceeded.

According to a further aspect, when, besides the first utilization side heat exchanger, the second utilization side heat exchanger, preferably a plurality of second utilization side heat exchangers, is/are operated, the controller may be configured to close the second valve and keep the first valve open.

Such a control situation of the opening states of the first and second valve may occur, when a priority is based on the production of domestic hot water (DHW) by the first utilization side exchanger heat arranged at the first refrigerant pipe.

Put differently, even though the second utilization side heat exchanger(s) may also require refrigeration capacity, the controller is in such a situation configured to maintain the priority directed to the supply of refrigerant to the first utilization side heat exchanger (to produce domestic hot water).

That is, when, for example, a prioritization of the DHW production has been performed by the controller during an initial parallel production of the first and second utilization side heat exchangers, the controller may be configured to maintain said prioritization, even though the second utilization side heat exchangers may also have a need for refrigeration capacity.

A similar control operation situation may occur, when a temperature of the space, in which the second utilization side heat exchanger is arranged, is below a desired temperature of the space.

If this is the case, the controller, even though the desired temperature in the space is not yet reached, may be configured to close the second valve and maintain the first valve open to prioritize the domestic hot water production via the first utilization side heat exchanger. That is, even though the second utilization side heat exchanger(s) should be operated in a parallel heating operation, the controller prioritizes the hot water production via the first utilization side heat exchanger.

Vice versa, the controller may, in a parallel heating operation of the first and second utilization side heat exchangers, also be configured to close the first valve and open the second valve in situations, in which a temperature in the tank of the hot water supply unit, i.e. the first utilization side heat exchanger, is still below a desired water temperature. That is, even though capacity is also required at the first utilisation side heat exchanger, the priority of the operation of the second utilization side heat exchanger(s) is maintained during the control operation of the controller during such extreme operational conditions.

Equally, the controller may be configured to close the second valve and open the first valve in cases, in which an actual discharge air temperature leaving an air conditioning indoor unit (as an exemplary form of a second utilization side heat exchanger) is still below a desired discharge air temperature thereof.

Similarly, the claimed controller configuration also may close the second valve and open the first valve during a control mode under extreme operational conditions, when an actual fan speed is above a predetermined fan speed, because the production of domestic hot water is prioritized.

According to an even further aspect, the controller may be configured to close the first valve or the second valve, even though both of the desired indoor space temperature and the desired hot water temperature have not yet been reached. Accordingly, a non-satisfying simultaneous operation of the first and second utilization side heat exchanger, when the required capacity exceeds a predetermined, available capacity on the "production side" of the refrigeration circuit, can be avoided.

According to a further aspect, the controller may be configured to determine a threshold between the required capacity and the predetermined capacity based on the amount of operated second utilization side heat exchangers. The controller may be configured to adapt said temperature threshold based on the amount of currently operated second utilization side heat exchangers.

According to an even further aspect, the second utilization side heat exchanger may be the air conditioning indoor unit and may be configured to be operated based on an expected condensation temperature during the heating operation of the refrigeration device. When the current condensation temperature is below the expected condensation temperature, the controller may be configured to close the second valve and open the first valve. Equal to the examples provided above, this control is performed during a parallel heating operation of the first and second utilization side heat exchangers when a prioritization is put on the domestic hot water production.

In all of the above-described embodiments, the predetermined capacity of the heat source side heat exchanger, may be determined by its size, efficiency, the refrigerant used therein, and/or the operational conditions, such as the outer air temperature. Equally, the predetermined capacity of the compressor may be determined by its power, size, or the like.

Further, the required capacity of the first utilization side heat exchanger, may, for example, be determined by a temperature threshold between a desired temperature of the hot water temperature in the hot water tank, and the actual hot water temperature. In line with the aforesaid, the required capacity of the second utilization side heat exchanger(s) may be determined, for example, by a temperature threshold between the actual room temperature to be heated and the desired temperature of the room.

BRIEF DESCRIPTION OF DRAWINGS

Subsequently, an illustration of an exemplary embodiment of a refrigeration device according to the present invention will be given. It shows.

DETAILED DESCRIPTION OF A PREFERRED EMBODIMENT

Figure 1:
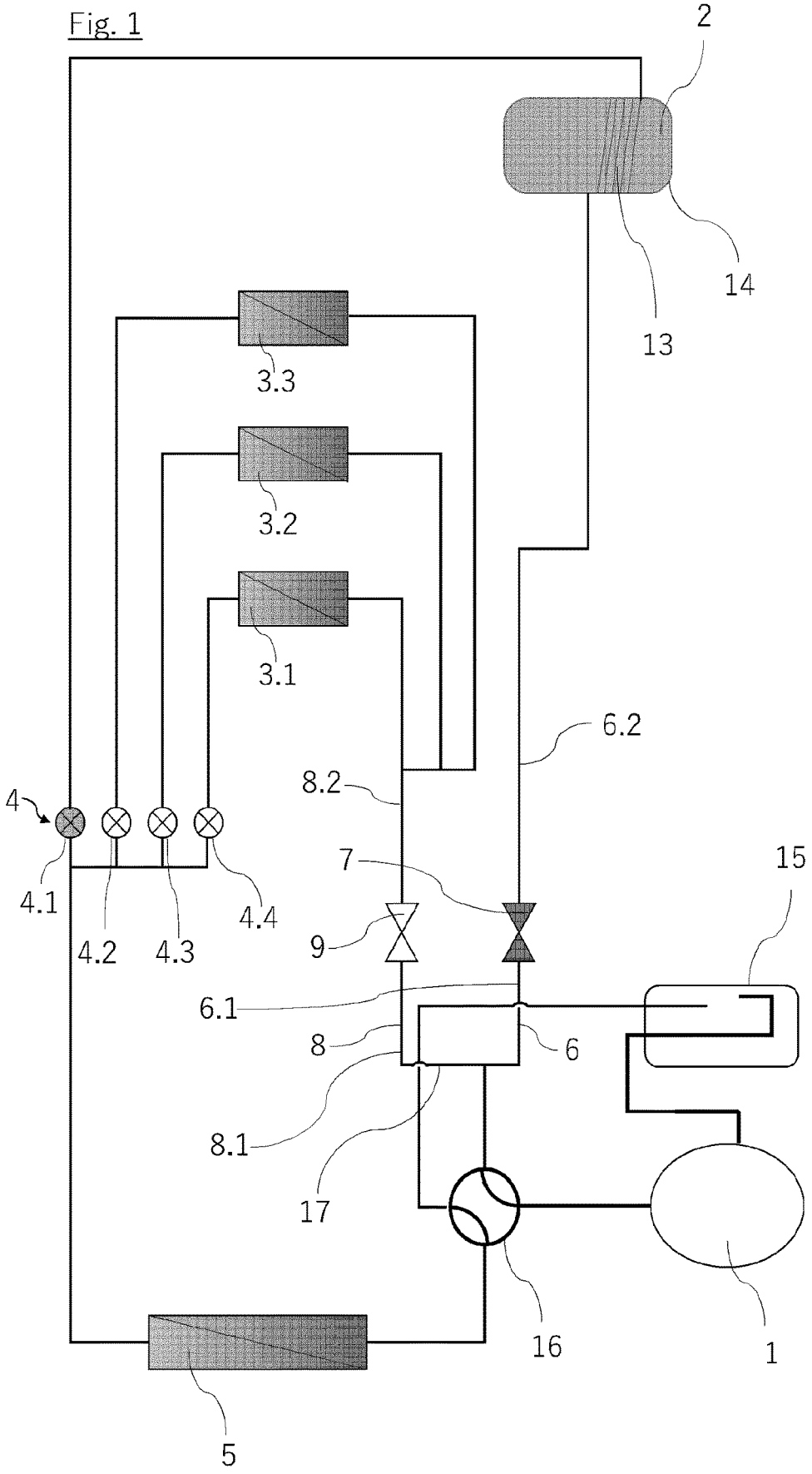
FIG. 1: A schematic illustration of a refrigeration device according to an embodiment of the present invention.

FIG. 1 shows a refrigeration device according to an embodiment of the present invention.

Here, a refrigerant circuit is constituted by a compressor 1, a plurality of utilization side heat exchangers, which will be described in more detail below, an expansion mechanism 4 and a heat source side heat exchanger 5. The compressor 1, the utilization side heat exchangers, the expansion mechanism 4 and the heat source side heat exchanger 5 are fluidly connected in series to constitute a refrigerant circuit.

As can be taken from FIG. 1, also a switching device 16, which is configured to switch the refrigerant circuit from a heating mode to a cooling mode is provided.

The exemplary embodiment of FIG. 1 shows a switching device 16 in the form of a four-way switching valve.

FIG. 1 also shows a configuration in which said switching device 16 is switched in such a manner that the refrigeration device is used in a heating mode. That is, the switching position of the switching device 16 enables that a pressurized refrigerant that leaves the compressor 1 subsequently flows to the plurality of utilization side heat exchangers to exchange heat, before it continues to stream to the expansion mechanism 4 in the refrigerant circuit. When the refrigeration device is used in a heating mode, heat is dispensed from the refrigerant to the surrounding environment, such as air or water (to be described later) in the utilization side heat exchangers.

When the refrigerant has flown through the utilization side heat exchangers, the refrigerant continues to stream to the expansion mechanism 4, when the refrigeration device is used in a heating mode. Said expansion mechanism 4 enables to reduce the pressure of the refrigerant, such that it then can continued to stream to the heat source side heat exchanger 5. Here, heat can once again be exchanged. When the refrigeration device is operated in the heating mode, the heat source side heat exchanger 5 can, for example, be arranged in an outdoor unit. Vice versa, the utilization side heat exchangers can be considered as indoor units.

When the refrigeration device is being operated in the heating mode, the refrigerant then flows from the heat source side heat exchanger 5 back to the compressor 1.

Here, FIG. 1 illustrates the optional provision of an accumulator 15, which is arranged intermittent between the heat source side heat exchanger 5 and the compressor 1 in the refrigeration circuit. In other words, the accumulator 15 is arranged upstream of the compressor 1 in the refrigerant circuit. This accumulator 15 thus enables the refrigerant being streamed through the refrigerant circuit to be accumulated before it streams into the refrigeration circuit.

Due to the compression of the refrigerant in the compressor 1, the refrigerant leaving the compressor 1 is in a gaseous state when the refrigeration device is used in the heating mode.

When the refrigeration device according to the exemplary embodiment of FIG. 1 is to be switched from a heating mode (as illustrated) to a cooling mode, the switching device 16 changes the flow direction of the refrigerant through the refrigerant circuit. In particular, the flow direction of the refrigerant through the refrigerant circuit is opposed, such that the refrigerant leaving the compressor 1 first streams through the heat source side heat exchanger 5, then through the expansion mechanism 4, and then through the utilization side heat exchangers before it returns back to the compressor 1.

Nonetheless, it will subsequently be focused on the refrigeration device being operated in a heating mode.

As mentioned earlier, a plurality of utilization side heat exchangers is provided. Here, a first utilization side heat exchanger 2 is provided in the refrigerant circuit. In the exemplary embodiment of FIG. 1, said first utilization side heat exchanger 2 is a hot water supply unit in the exemplary form of a coil 13 in a water tank 14. Hence, said hot water supply unit is an exemplary embodiment of the first utilization side heat exchanger 2 configured to produce domestic hot water, when the refrigeration device is used in a heating mode (as illustrated in FIG. 1).

Yet, it is also derivable from FIG. 1 that not only a first utilization side heat exchanger 2, but also a plurality of second utilization side heat exchangers 3.1, 3.2, 3.3 is provided in the refrigerant circuit. Here, three second utilization side heat exchangers 3.1, 3.2, 3.3 are exemplarily provided. These three second utilization side heat exchangers 3.1, 3.2, 3.3 are arranged in parallel (see FIG. 1).

In the exemplary embodiment, the three second utilization side heat exchangers 3.1, 3.2, 3.3 are illustrated as air conditioning indoor units for heating a space, in which the second utilization side heat exchangers 3.1, 3.2, 3.3 are positioned, when the refrigeration device is used in a heating mode.

As mentioned earlier, said air conditioning indoor units 3.1, 3.2, 3.3 may also be capable of cooling a space in which the second utilization side heat exchangers are respectively positioned, when the refrigeration device is used in a cooling mode.

Instead of being configured as being an air conditioning indoor unit, one, more or all of the second utilization side heat exchangers 3.1, 3.2, 3.3 provided in the refrigerant circuit may also be configured as radiators for heating the space and/or for cooling the space in which the respective second utilization side heat exchangers 3.1, 3.2, 3.3 are arranged.

It may, in this context, be well known that the second utilization side heat exchangers 3.1, 3.2, 3.3 do not have to be arranged in the same space to be heated and/or to be cooled, but they can also be arranged in different spaces, for example, in different rooms of a building in order to heat or cool different rooms of a building or to establish difference temperatures therein.

Accordingly, the configuration of the first utilization side heat exchanger 2 and the provision of at least one, here three, second utilization side heat exchangers 3.1, 3.2, 3.3 enables to achieve a so-called "combined system", which is commonly known as a domestic hot water and air conditioning combined system (abbreviated as a DHW-DX combined system).

As elaborated in more detail below, the first utilization side heat exchanger 2 and the plurality of second utilization side heat exchangers 3.1, 3.2, 3.3 are arranged in parallel.

To achieve a parallel production of hot water by the first utilization side heat exchanger 2 and heating of a space by the plurality of air conditioning indoor units 3.1, 3.2, 3.3, a first refrigerant pipe 6, which extends from the compressor 1 to the first utilization side heat exchanger 2, here subsequently in the form of the hot water supply unit, is provided.

Said first refrigerant pipe 6 comprises a first valve 7. Said first valve 7 divides said first refrigerant pipe 6 in a section on a upstream side 6.1 of the first valve 7, when the refrigeration device is used in a heating mode, and in a section on a downstream side 6.2 of the first valve 7, when the refrigeration device is used in a heating mode.

Said first valve 7 is configured to at least fully open and fully close the first refrigerant pipe 6.

Additionally, a second refrigerant pipe 8 is provided, which extends from the compressor 1 to the second utilization side heat exchangers 3.1, 3.2, 3.3. Said second refrigerant pipe 8 comprises a second valve 9.

Similar to the first refrigerant pipe 6, the second refrigerant pipe 8 is divided in an upstream side 8.1 of the second valve 9 and a downstream side 8.2 of the second valve 9. Similar to the first valve 7, also the second valve 9 is configured to at least fully open and fully close the second refrigerant pipe 8.

In the exemplary embodiment illustrated in FIG. 1, the first valve 7 and second valve 9 are configured as solenoid valves, which are configured to at least fully open and fully close the first refrigerant pipe 6 and the second refrigerant pipe 8. Also, the first valve 7 and second valve 9 may be configured as motor operated valves. In this case, they are configured to adjust the amount of refrigerant flowing in the first refrigerant pipe 6 and the second refrigerant pipe 8.

As mentioned earlier, the refrigeration device as illustrated in FIG. 1 enables a parallel production of domestic hot water and warm air for heating up a space.

To do so, the first utilization side heat exchanger 2 and the second utilization side heat exchangers 3.1, 3.2, 3.3 are arranged in parallel.

Specifically, the first refrigerant pipe 6 and the second refrigerant pipe 8 extend in parallel from the compressor 1 via a branching pipe 17 arranged on a downstream side of the compressor 1. That is, the branching pipe 17 enables to stream refrigerant leaving the compressor 1 to both of the first refrigerant pipe 6 and the second refrigerant pipe 8 in order to deliver refrigerant to the first utilization side heat exchanger 2 and the three second utilization side heat exchangers 3.1, 3.2, 3.3 in the exemplary form of air conditioning indoor units.

In this context, it can be taken from FIG. 1 that the three air conditioning indoor units, as an exemplary form of the second utilization side heat exchangers 3.1, 3.2, 3.3, are arranged on a downstream side 8.2 of the second valve 9 in the second refrigerant pipe 8. Hence, when the refrigeration device is used in the heating mode, the first refrigerant pipe 6 and the second refrigerant pipe 8 are gas pipes containing the refrigerant in at least partial, preferably completely, gaseous state.

The expansion mechanism 4 of the refrigeration device as illustrated in FIG. 1 comprises a first expansion valve 4.1 arranged downstream of the first utilization side heat exchanger 2.

Additionally, the expansion mechanism 4 also comprises a plurality of second expansion valves 4.2, 4.3, 4.4 arranged downstream of and respectively connected to the second utilization side heat exchangers 3.1, 3.2, 3.3.

In other words, not only the hot water supply unit 2 is provided with a first expansion valve 4.1 arranged on a downstream side thereof, but also each of the three illustrated air conditioning indoor units 3.1, 3.2, 3.3 is respectively provided with an own expansion valve 4.2, 4.3, 4.4.

As illustrated in FIG. 1, the three air conditioning indoor units 3.1, 3.2, 3.3 also extend in parallel in said second refrigerant pipe 8.

The refrigerant device according to the exemplary embodiment also comprises a (non-illustrated) controller, which is configured to fully close the first valve 7, when the operation of the first utilization side heat exchanger 2, i.e. the hot water supply unit, is or shall be stopped and/or which is configured to fully close the second valve 9, when the operation of the second utilization side heat exchangers 3.1, 3.2, 3.3 is or shall be stopped.

That is, the (non-illustrated) controller can control the refrigerant flow to the first and the second utilization side heat exchangers.

To do so, the controller, which is configured to control the operation of the first valve and the second valve, performs a control logic, which will be described in more detail below.

Figure 2:
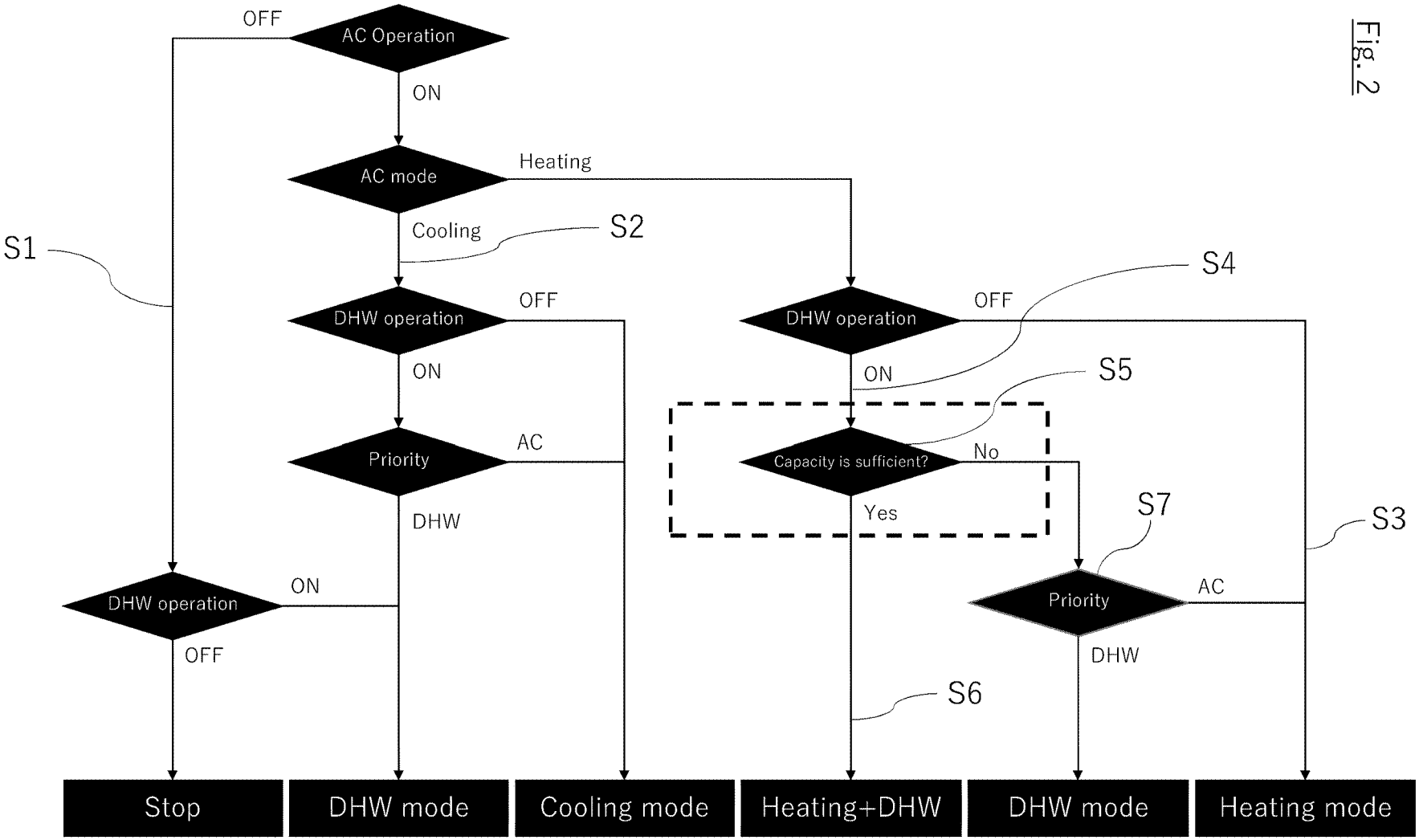
FIG. 2: A flowchart illustrating the control behavior of the refrigeration device according to the embodiment of the present invention.

For more details, it will now be referred to the flowchart diagram of FIG. 2.

As mentioned earlier, the present application is directed to improving non-satisfying situations for a user of a DHW-DX combined system.

Such a non-satisfying situation may occur when a parallel domestic hot water (DHW) production and domestic heating (DX) is desired, but the system, in particular the compressor and/or the heat source side heat exchanger, cannot supply enough capacity to fulfill the heat exchange capacity needs for both of domestic hot water production and domestic heating.

In this context, the bottom section of the flowchart diagram of FIG. 2 once again highlights that such a DHW-DX combined system can achieve different operation situations.

For example, the combined DHW-DX system can be completely stopped, can be operated in a cooling mode only, can be operated in a domestic hot water production mode only, a (domestic) heating mode only, or can provide a simultaneous heating, for example, of an indoor space, in which a second utilization side heat exchanger is arranged, and a hot water production.

However, such a simultaneous heating of hot water in a tank (via the first utilisation side heat exchanger) and of an indoor space (via at least one second utilisation side heat exchanger) may provoke problems, when extreme operating situations occur.

In such extreme operating situations, the required capacity of the DHW-DX combined system operated in a simultaneous heating mode may exceed the predetermined capacity, i.e. the available capacity of the system.

In such a situation, which will be elaborated and explain in more detail below, the controller provides a prioritization of the domestic hot water production or domestic heating in order to achieve an improved operational behavior.

Such extreme operating situations may occur when the first and second utilization side heat exchangers are operated in a and, heating mode, for example, drastic temperature differences between an actual water temperature in the tank or an actual room temperature and a desired water temperature or a desired room temperature are present.

Equally, such extreme operating situations, which require the above-mentioned prioritization may occur, when a large temperature delta in a room is existent and the at least one second utilization side heat exchanger is an air conditioning indoor unit comprising a fan, and the available fan speed does not suffice to achieve the required air conditioning performance, while the domestic hot water is produced in parallel to that.

Vice versa, such a prioritization, is, for example, not required when neither the air conditioning operation nor the domestic hot water production operation is required, i.e. the DHW-DX combined system is stopped (cf. the first flow chart column highlighted as step S1 in FIG. 2)

Equally, no prioritization in a DHW-DX combined system may be required in situations, in which, for example, merely an air conditioning cooling mode is performed (see the second column in FIG. 2 highlighted with step S2).

In the air conditioning cooling mode, the system must decide whether the air conditioning cooling mode has to be maintained, or the overall system should be switched to domestic hot water operation and/or domestic heating. This is because of the constructional constraints of a DHW-DX combined system, which does not enable to cool, for example, an indoor space via a second utilization side heat exchanger, while producing domestic hot water via a first utilization side heat exchanger (cf. the bottom part of step S2 in FIG. 2).

Also no situations in a DHW-DX combined system that require any prioritization occur, when the air conditioning operation may be turned to a heating operation but the domestic hot water production is turned off, i.e. the first valve is closed (see the sixth column highlighted with step S3 in FIG. 2).

Nonetheless, the controller is configured to compare the available capacity of, for example, the heat source side heat exchanger and/or the compressor, with a required capacity of the first and second utilization side heat exchangers, when the DHW-DX combined system is operated and both, the first utilization side heat exchanger and the second utilization side heat exchanger are operated in a heating mode. This comparison is highlighted by step S4 in FIG. 2.

When both the first utilization side heat exchanger and the second utilization side heat exchanger(s) are used in a heating mode operation of the DHW-DX combined system, the described controller determines whether the available, predetermined capacity of the compressor and/or the heat source side heat exchanger is sufficient to fulfill the capacity needs of the first and second utilization side heat exchangers (cf. step S5 in FIG. 2).

When the capacities of the heat source side heat exchanger and/or the compressor suffice to address the capacity needs of the first and second utility side heat exchangers, no prioritization is required and the DHW-DX combined system can be operated in a heating plus domestic hot water production mode, i.e. in a simultaneous operation mode, in which a room is heated, while domestic hot water is produced (cf. step S6 in FIG. 2).

However, when the controller determines that the required capacity of the utilization side heat exchangers on the "utilization side" of the refrigeration circuit exceeds the capacity, which the heat source side heat exchanger and/or the compressor on the "production side" of the refrigeration circuit can deliver, i.e. the available heat exchange potential does not suffice to fulfill the capacity needs of the utilization side heat exchangers, the controller performs a prioritization of the domestic hot water production via the first utilization side heat exchanger or the performance of the second utilization side heat exchanger (cf. step S7 in FIG. 2).

Put differently, when extreme operational conditions arise during a simultaneous DHW-DX operation, the controller prioritizes one thereof and closes the first valve, when the operation of the second utilization side heat exchanger is prioritized, or closes the second valve, when the operation of the first utilization side heat exchanger, i.e. the production of hot water, is prioritized (see step S7 condition in FIG. 2).

Here, the controller may be a continuous system logic, that continuously evaluates whether such extreme operational conditions are still apparent and whether the operation of one of the first and second utilization side heat exchangers must be prioritized or whether a simultaneous operation of the utilization side heat exchangers in a parallel operation can be reactivated.

If no parallel operation in the heating mode is possible due to the above-describe capacity gap, the prioritization according to step S7 of FIG. 2 is to be performed.

Here, the controller is not only configured to close the first valve 7 or the second valve 9, when said required capacity exceeds the predetermined capacity, the controller may even be capable of maintaining the first valve 7 or second valve 9 closed when a corresponding prioritization is applied by the controller.

For example, when, besides the first utilization side heat exchanger 2, the plurality of second utilization side heat exchangers 3.1, 3.2, 3.3 are operated, the controller may be configured to close the second valve 9 and keep the first valve open 7.

Such a control situation of the opening states of the first valve 7 and second valve 9 may occur, when a priority is put on the production of domestic hot water (DHW) by the first utilization side heat exchanger 2 arranged at the first refrigerant pipe 6.

Put differently, even though the second utilization side heat exchangers 3.1, 3.2, 3.3 may also require refrigeration capacity, the controller is in such a situation configured to maintain the priority directed to the supply of refrigerant to the first utilization side heat exchanger 2 (to produce domestic hot water).

That is, when, for example, a prioritization of the DHW production has been performed by the controller during an initial parallel operation of the first and second utilization side heat exchangers 2, 3.1, 3.2, 3.3, the controller may be configured to maintain said prioritization, even though the second utilization side heat exchangers 3.1, 3.2, 3.3 also have a need for refrigeration capacity.

Also, for example, if a condition that a plurality of the second utilization side heat exchangers 3.1, 3.2 3.3 are simultaneously operated is determined to be an extreme operational condition by the controller, the controller may be configured to close the second valve 9 and keep the first valve 7 open.

A similar control operation situation may occur in step S7 of FIG. 2, when a temperature of the space, in which the second utilization side heat exchangers 3.1, 3.2, 3.3 are arranged, is below a desired temperature of the space. For example, 19 degrees can be cited as such a temperature. If the room temperature is lower than 19 degrees, the controller may determine that extreme operation is necessary to heat the space and still prioritize hot water production by the first utilization side heat exchanger 2.

The temperature can be changed according to the setting of the fan speed. That is, if the setting of the fan speed is small, it can be changed to a smaller temperature, for example, 18 degrees. If the setting of the fan speed is large, it can be changed to a larger temperature, for example, 23 degrees. By this constitution, it is possible to prevent an unpleasant feeling that the actual discharge air temperature is considered cold by a user.

If this is the case, the controller, even though the desired temperature in the space is not yet reached, may be configured to close the second valve 9 and maintain the first valve 7 open to prioritize the domestic hot water production via the first utilization side heat exchanger 2. That is, even though the second utilization side heat exchangers 3.1, 3.2, 3.3 should be operated in a parallel heating operation, the controller prioritizes the hot water production via the first utilization side heat exchanger 2.

Vice versa, the controller may, in an initial parallel heating operation of the first utilization side heat exchanger 2 and second utilization side heat exchangers 3.1, 3.2, 3.3, also be configured to close the first valve 7 and maintain the opening of the second valve 9 in situations, in which a temperature in the tank 14 of the hot water supply unit 2 is still below a desired water temperature. That is, even though capacity is also required at the first utilisation side heat exchanger 2, the priority of the operation of the second utilization side heat exchanger 3.1, 3.2, 3.3 is maintained during the control operation of the controller during such extreme operational conditions.

Equally, the controller may be configured to close the second valve 9 and open the first valve 7 in cases, in which an actual discharge air temperature leaving an air conditioning indoor unit is still below a desired discharge air temperature thereof. By this constitution, it is possible to prevent an unpleasant feeling that the actual discharge air temperature is considered cold by a user.

Similarly, the claimed controller configuration also may close the second valve 9 and open the first valve 7 during a control mode under extreme operational conditions, when an actual fan speed is above a predetermined fan speed, because the production of domestic hot water is prioritized.

Also, for example, if a condition that an actual fan speed is above a predetermined fan speed is determined to be extreme operational condition by the controller, the controller may be configured to close the second valve 9 and keep the first valve 7 open.

Similarly, for example, if a condition that the current condensation temperature of an operated second heat exchanger is below an expected condensation temperature of the second heat exchanger is met, the controller may be configured to close the second valve 9 and keep the first valve 7 open. By this constitution, it is possible to prevent an unpleasant feeling that the actual discharge air temperature is considered cold by a user.

With respect to step S7 in FIG. 2, the controller may also be configured to close the first valve 7 or the second valve 9, even though the desired indoor space temperature and the desired hot water temperature have not yet been reached. Accordingly, a non-satisfying simultaneous operation of the first utilization side heat exchanger 2 and second utilization side heat exchangers 3.1, 3.2, 3.3, when the required capacity exceeds a predetermined, available capacity on the "production side" of the refrigeration circuit, can be avoided.

In this context, the available capacity may be a maximum capacity or a predetermined capacity (including a safety factor) of the heat source side heat exchanger and/or the compressor.

Equally, the controller may evaluate the required capacity based on an amount of provided second utilization side heat exchangers and may be configured to adjust the capacity based on an amount of provided utilization side heat exchangers.

Equally, the controller may determine the required capacity based on a threshold between an actual discharge air temperature leaving the air conditioning indoor unit (as an exemplary form of a second utilization side heat exchanger) and a desired discharge air temperature. Said judgment may be crucial to calculate via the controller whether the available capacity of the compressor and/or the heat source side heat exchanger is sufficient to provide a simultaneous operation of the domestic hot water production and a heating mode.

In cases, when the actual temperature, for example, in the space, in which the second utilization side heat exchanger is positioned reaches or even exceeds a desired temperature and the heating goal is, thereby, achieved, the controller may be configured to close the second valve and open the first valve. Equally, the controller may close the first valve and open the second valve, when the actual temperature in the hot water supply unit reaches or exceeds a desired temperature.

According to another embodiment, the controller may be configured to close the first valve or the second valve based on a predetermined user priority. That is, the controller may contain a storage that is configured to store information regarding a user priority with regard to domestic hot water production and a heating operation and may use said information when crucial operation conditions occur.

In addition, the controller may be configured to change the predetermined user priority based on a time of the day.

REFERENCE LIST

1 compressor
2 first utilization side heat exchanger
3.1, 3.2, 3.3 second utilization side heat exchanger (air conditioning indoor units)
4 expansion mechanism
4.1 first expansion valve
4.2, 4.3, 4.4 second expansion valve
5 heat source side heat exchanger
6 first refrigerant pipe
6.1 upstream side of the first valve
6.2 downstream side of the first valve
7 first valve
8 second refrigerant pipe
8.1 upstream side of the second valve
8.2 downstream side of the second valve
9 second valve
13 coil
14 water tank
15 accumulator
16 switching device
17 branching pipe

The invention claimed is:

1. A refrigeration device configured to be used in a heating mode and a cooling mode, comprising:

to constitute a refrigerant circuit, a compressor, a switching device, a plurality of utilization side heat exchangers, at least one expansion valve and a heat source side heat exchanger fluidly connected in series in this order when the refrigerant device is used in a heating mode, a branch pipe arranged on a downstream side of the switching device when the refrigerant device is operated in the heating mode, the branch pipe connecting the switching device to a first refrigerant pipe and a second refrigerant pipe, wherein the first refrigerant pipe extends to a first utilization side heat exchanger of the plurality of utilization side heat exchangers and comprises a first valve configured to at least fully open and fully close the first refrigerant pipe, and the second refrigerant pipe extends to a second utilization side heat exchanger of the plurality of utilization side heat exchangers and comprises a second valve configured to at least fully open and fully close the second refrigerant pipe, the refrigeration device further comprises a controller, which is configured to control the operation of the first valve and the second valve, wherein when the first utilization side heat exchanger and the second utilization side heat exchanger are both operated when the refrigeration device is used in the heating mode, the controller is configured to compare a predetermined capacity of the heat source side heat exchanger and/or the compressor with a required capacity of the first utilization side heat exchanger and the second utilization side heat exchanger, and when the required capacity exceeds the predetermined capacity, the controller is configured to close the first valve or the second valve.

2. The refrigeration device according to claim 1, wherein the predetermined capacity is a maximum capacity of the heat source side heat exchanger and/or the compressor.

3. The refrigeration device according to claim 1, wherein the controller is configured to close the first valve or the second valve based on a predetermined user priority.

4. The refrigeration device according to claim 3, wherein the controller is configured to change the predetermined user priority based on a time of day.

5. The refrigeration device according to claim 1, wherein the first utilization side heat exchanger is a hot water supply unit for producing domestic hot water, when the refrigeration device is used in a heating mode.

6. The refrigeration device according to claim 1, wherein a second utilization side heat exchanger is an air conditioning indoor unit or a radiator for heating a space in which the second utilization side heat exchanger is positioned when the refrigeration device is used in a heating mode and/or for cooling the space in which the second utilization side heat exchanger is positioned when the refrigeration device is used in a cooling mode.

7. The refrigeration device according to claim 1, wherein, downstream of the second valve in the second refrigerant pipe, a plurality of second utilization side heat exchangers are arranged in parallel.

8. The refrigeration device according to claim 7, wherein the controller is configured to determine the predetermined capacity based on an amount of provided second utilization side heat exchangers.

9. The refrigeration device according to claim 8, wherein the controller is configured to determine and/or adjust the predetermined capacity based on an amount of operated second utilization side heat exchangers.

10. The refrigeration device according to claim 1, wherein the controller is configured to determine the predetermined capacity based on a volume of the first utilization side heat exchanger, and/or a volume of the compressor.

11. The refrigeration device according to claim 1, wherein the controller is configured to determine the required capacity based on a threshold between a refrigerant temperature at the heat source side heat exchanger and the refrigerant temperature at the second utilization side heat exchanger, or based on a threshold between an actual temperature in the space in which the second utilization side heat exchanger is positioned when the refrigeration device is used in a heating mode and a desired temperature in the space, or based on a threshold between an actual temperature in the first utilization side heat exchanger, and a desired temperate in the first utilization side heat exchanger.

12. The refrigeration device according to claim 6, wherein the second utilization side heat exchanger is the air conditioning indoor unit, and wherein the controller is configured to determine the required capacity based on a threshold between an actual discharge air temperature leaving the air conditioning indoor unit and a desired discharge air temperature.

13. The refrigeration device according to claim 1, wherein the second utilization side heat exchanger comprises a fan, and wherein the controller is configured to determine the required capacity based on a threshold between an actual fan speed and a maximum fan speed.

14. The refrigeration device according to claim 6, wherein the controller is configured to close the second valve and open the first valve when the actual temperature in the space in which the second utilization side heat exchanger is positioned reaches or exceeds a desired temperature in the space, and/or wherein the controller is configured to close the first valve and open the second valve when the actual temperature in the first utilization side heat exchanger reaches or exceeds the desired temperature.

15. The refrigeration device according to claim 2, wherein the controller is configured to close the first valve or the second valve based on a predetermined user priority.

16. The refrigeration device according to claim 2, wherein the first and second refrigerant pipes extend in parallel from the compressor, via a branching pipe arranged on a downstream side of the compressor.

17. The refrigeration device according to claim 3, wherein the first and second refrigerant pipes extend in parallel from the compressor, via a branching pipe arranged on a downstream side of the compressor.

18. The refrigeration device according to claim 4, wherein the first and second refrigerant pipes extend in parallel from the compressor, via a branching pipe arranged on a downstream side of the compressor.

* * * * *